US005947553A

United States Patent [19]

Tseng

[11] Patent Number: 5,947,553

[45] Date of Patent: Sep. 7, 1999

[54] FOLDING CHAIR

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 08/972,512

[22] Filed: Nov. 18, 1997

[51] Int. Cl.[6] ..... A47C 4/44

[52] U.S. Cl. ..... 297/39; 297/19; 297/47; 297/364

[58] Field of Search ..... 297/19, 21, 39, 297/35, 364, 363, 47, 46

[56] References Cited

U.S. PATENT DOCUMENTS

| | | | |
|---|---|---|---|
| 192,898 | 7/1877 | Clough | 297/364 |
| 518,751 | 4/1894 | Chambers | 297/21 |
| 1,501,300 | 7/1924 | Bayles | 297/363 |
| 3,866,250 | 2/1975 | Bradford | 297/364 X |
| 5,261,132 | 11/1993 | Bufford et al. | 297/364 X |
| 5,364,165 | 11/1994 | Okamoto | 297/364 |
| 5,499,856 | 3/1996 | Sorrell et al. | 297/35 X |
| 5,573,261 | 11/1996 | Miller | 297/440.24 X |

FOREIGN PATENT DOCUMENTS

| | | | |
|---|---|---|---|
| 571640 | 3/1959 | Belgium | 297/19 |
| 623934 | 2/1963 | Belgium | 297/19 |
| 179409 | 4/1986 | European Pat. Off. | 297/39 |
| 894 | 1/1886 | United Kingdom | 297/39 |
| 668506 | 3/1952 | United Kingdom | 297/19 |
| 9009749 | 9/1990 | WIPO | 297/19 |

*Primary Examiner*—Peter M. Cuomo
*Assistant Examiner*—David E. Allred
*Attorney, Agent, or Firm*—Ladas & Parry

[57] ABSTRACT

A folding chair includes front and rear leg frames which are pivotally connected to a seat frame, a backrest frame having a lower end portion pivoted to the rear leg frame, a pair of armrest members which have front ends pivoted to the front leg frame and rear ends pivoted to the backrest frame, and a pair of connecting rods which have front ends pivoted to the front portion of the seat frame and rear ends pivoted the backrest frame. A pair of locking plates are fixedly attached to the backrest frame and have lower portions which are movable towards two side tubes of the seat frame when the chair is unfolded. The side tubes of the seat frame are provided with resilient protrusions which are automatically engageable with engaging slots of the locking plates, respectively, when the chair is unfolded, thereby eliminating the need to operate the locking plates during folding and unfolding operations.

2 Claims, 5 Drawing Sheets

FOLDING CHAIR

BACKGROUND OF THE INVENTION

1. Field of the Invention

This invention relates to a folding chair, more particularly to a folding chair including a seat frame and a backrest frame which are provided with interlocking means for locking them against relative movement when the chair is unfolded for use.

2. Brief Description of the Relevant Art

Foldable chairs are designed to be stretchable to a position for sitting by the user and foldable for ease of storage and transport. In order to prevent such a chair from being undesirably folded when in use, locking means is provided therein to lock and stabilize the chair in an unfolded position. An example of a folding chair is shown in FIGS. 1 and 2, wherein a seat frame 11 has two rear end portions which are respectively pivoted to two rear leg members 13 of a U-shaped rear leg frame via pivot shafts 112. The forwardly bending parts 131 of the rear leg members 13 are pivoted to a backrest frame 14. A front leg frame 15 is pivoted to two sides of the seat frame 11 via pivot shafts 113 which also serve to connect pivotally a pair of connecting rods 16 to the front leg frame 15. The front leg frame 15 is further connected to a pair of armrest members 17 at the top ends of the front leg frame 15. A fabric sheet 18 is mounted to the backrest frame 14 and the seat frame 11. When folding the chair 1 by turning the seat frame 11 relative to the rear leg members 13, the seat frame 11 is moved towards the backrest frame 14, and the front and rear leg frames are then turned to the bottom side of the seat frame 11.

In order to prevent the chair from being unfolded when in use, side tubes 111 of the seat frame 11 are provided with protrusions 114 releaseably engage locking plates 19 (only one is shown in FIG. 2) which are turnable about pivot shaft 132 toward the side tubes 111 so as to engage the protrusions 114 with their notches 191. By turning upward the locking plates 19 from the protrusions 114, the seat frame 11 can be folded over the backrest frame 14. Although the locking plates 19 can provide a safe locking effect, they are inconvenient in that they need to be operated by hand for folding and unfolding the chair. In case the user forgets to manipulate the locking plates 19, the chair may undesirably move to its folded position and harm the user.

SUMMARY OF THE INVENTION

It is an object of the present invention to provide a folding chair of the above described type with locking means which is automatically engageable with complementary engaging means when the chair is unfolded, thereby eliminating the need to operate the locking means.

According to the present invention, a foldable chair comprises a seat frame having a front side, and two opposite side tubes extending rearward from two ends of the front side, a substantially U-shaped rear leg frame having two substantially parallel rear leg members pivoted to rear ends of the side tubes of said seat frame, respectively, first pivot shafts which connect the rear leg members to the side tubes, a substantially U-shaped backrest frame having two substantially parallel backrest frame members pivotally connected to the rear leg members, respectively, second pivot shafts which connect the rear leg members to the backrest frame members and each of which is parallel to an adjacent one of the first pivot shafts, a substantially U-shaped front leg frame having two substantially parallel front leg members pivoted respectively to the side tubes of the seat frame adjacent the front side, third pivot shafts which connect the front leg members to the side tubes, respectively a pair of armrest members having front ends respectively pivoted to the front leg members above the side tubes and rear ends pivoted respectively to the backrest frame above the second pivot shafts, a pair of connecting rods having front ends pivotally connected to the seat frame and the front leg frame via the third pivot shafts, and rear ends pivotally connected to the backrest frame members, respectively, fourth pivot shafts which connect the connecting rods to the backrest frame members, respectively, a locking plate having an upper portion fixedly connected to one of the backrest frame members, the locking plate longitudinally extending along the backrest frame member adjacent to a bottom end of the backrest frame member and having a lower portion which is provided with an engaging slot, and a resilient protrusion provided in one of the side tubes adjacent to the backrest frame member so as to releaseably engage the engaging slot when the backrest frame and the seat frame are unfolded.

The side tubes are substantially horizontal and extend below the bottom ends of the backrest frame members when the seat frame is unfolded, and the lower portion of the locking plate extends beyond the bottom end of one backrest frame member and over one side tube when the seat frame is unfolded, and engages the resilient protrusion with the engaging slot, thereby rigidly connecting with one side tube to lock the seat frame against movement relative to the backrest frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
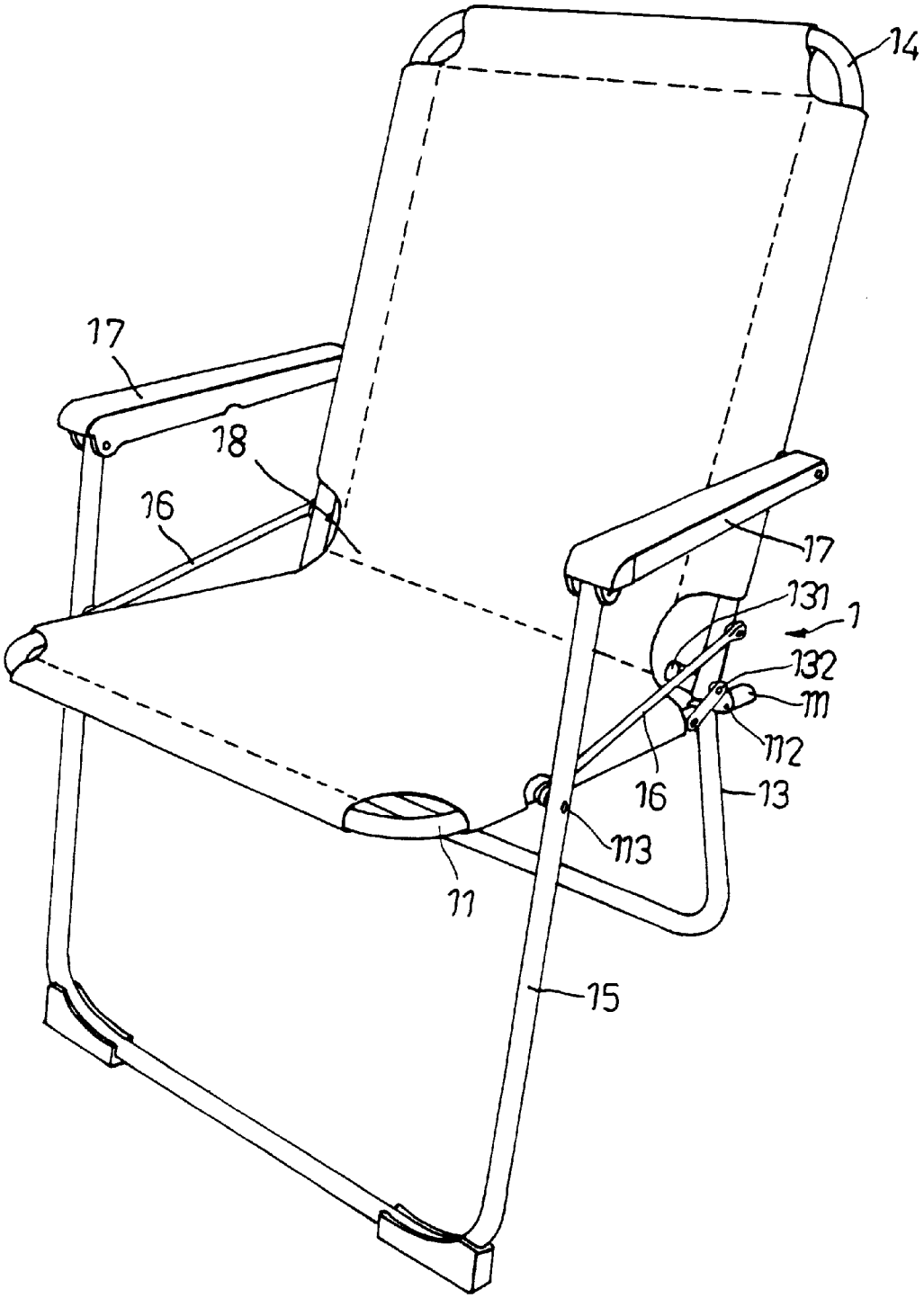
FIG. 1 PRIOR ART
FIG. 1 is a perspective view of a conventional folding chair.
Figure 2:
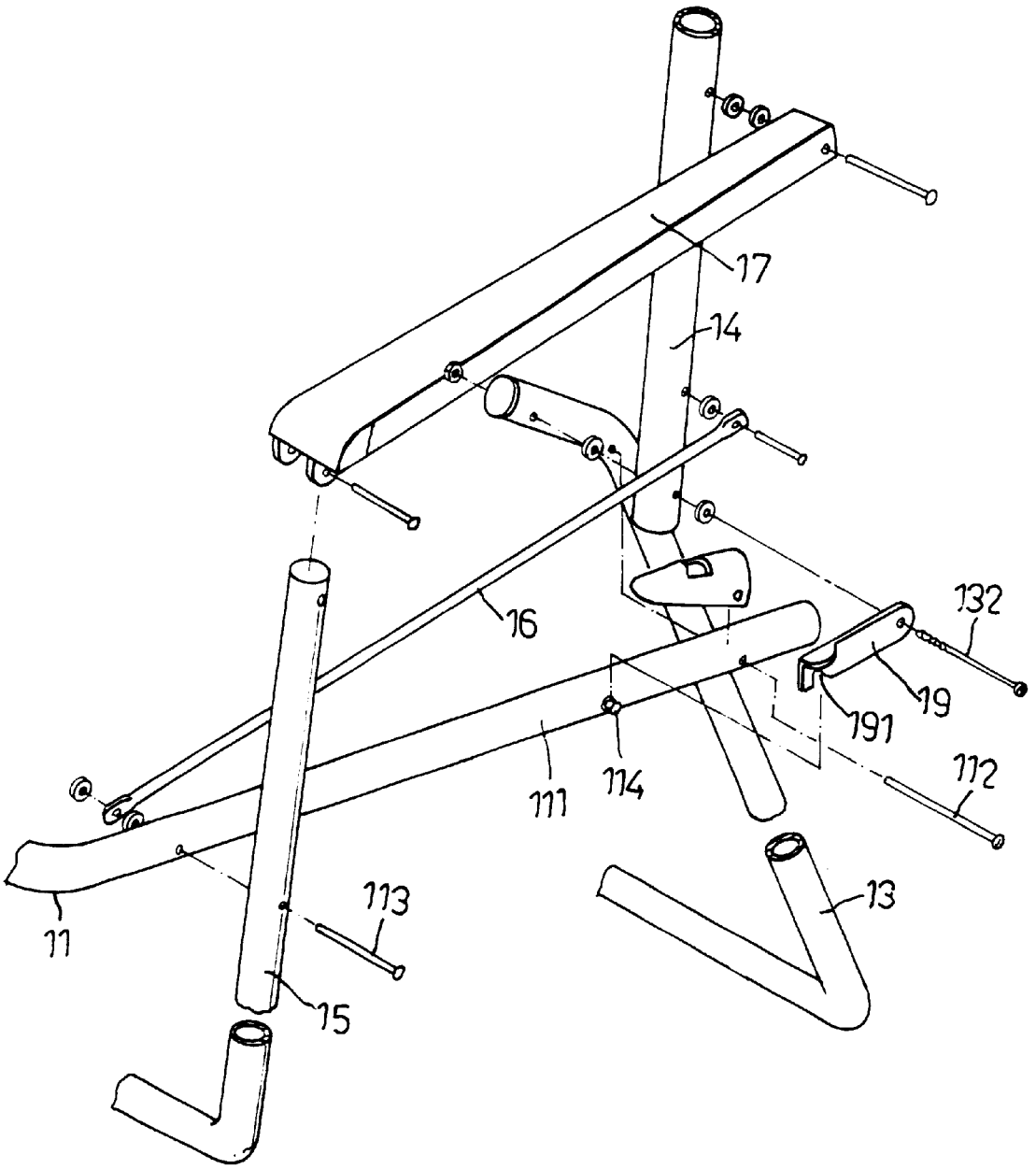
FIG. 2 PRIOR ART
FIG. 2 is an exploded view of a portion of the chair of FIG. 1.
Figure 3:
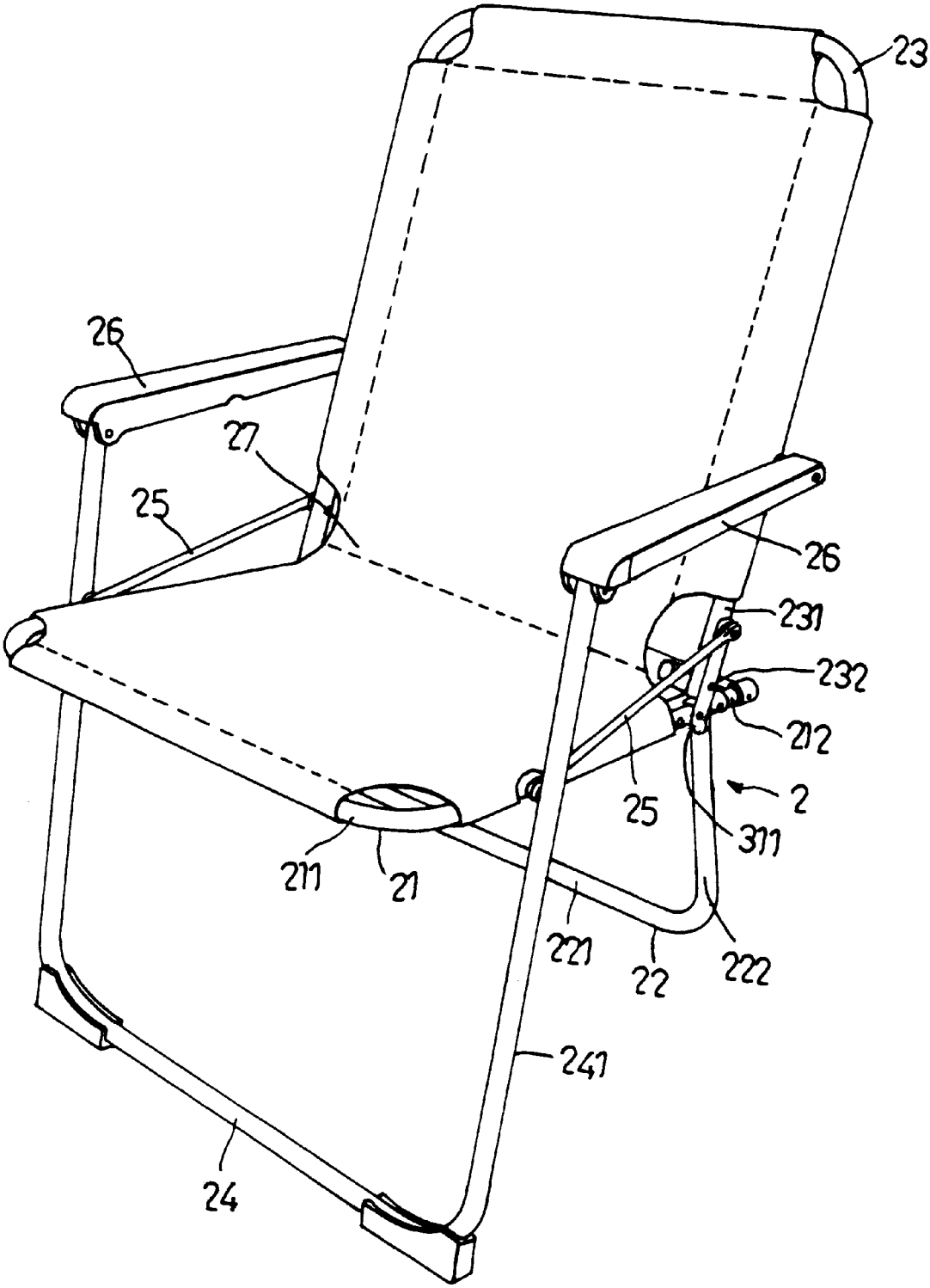
FIG. 3 is a perspective view of a folding chair embodying the present invention.
Figure 4:
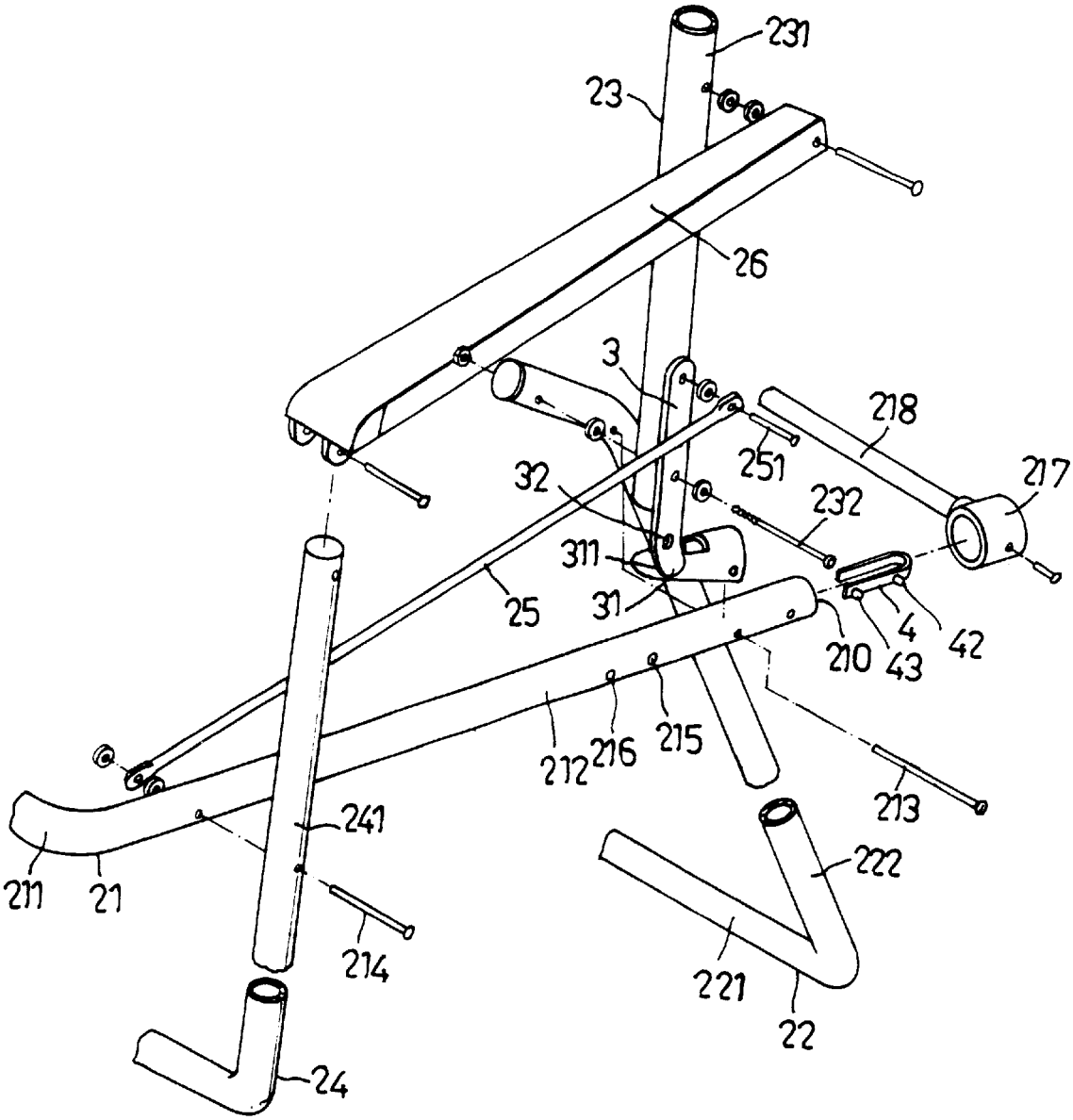
FIG. 4 is an exploded view of a portion of the folding chair of FIG. 3.

Referring to FIGS. 3 and 4, a folding chair 2 embodying the present invention is shown to comprise a seat frame 21 which has a front side 211 and two substantially parallel side tubes 212 which extend rearwardly from two opposite ends of the front side 211. The rear ends of the side tubes 212 are opened to form passages 210. A rear leg frame 22 has a bottom support part 221 and two substantially parallel rear leg members 222 each of which is pivoted to the respective side tube 212 by means of a first pivot shaft 213.

A backrest frame 23 of substantially inverted U-shape has two backrest frame members 231 which extend downward to be respectively pivoted to the forwardly bending upper parts of the rear leg members 222 by means of second pivot shafts 232. A substantially U-shaped front leg frame 24 has two substantially parallel front leg members 241 which are pivoted to the side tubes 212 by means of third pivot shafts 214, respectively. Furthermore, the top ends of the front leg members 241 are respectively pivoted to the front ends of a pair of armrest members 26. The rear ends of armrest members 26 are respectively pivoted to the backrest frame members 231. A fabric support sheet 27 is mounted to the seat frame 21 and the backrest frame 23.

There is a pair of connecting rods 25 each of which has a front end pivoted to the respective side tube 212 by means of the respective third pivot shaft 214. A rear end of each connecting rod 25 is pivoted to the respective backrest frame member 231 by means of a respective fourth pivot shaft 251.

Figure 5:
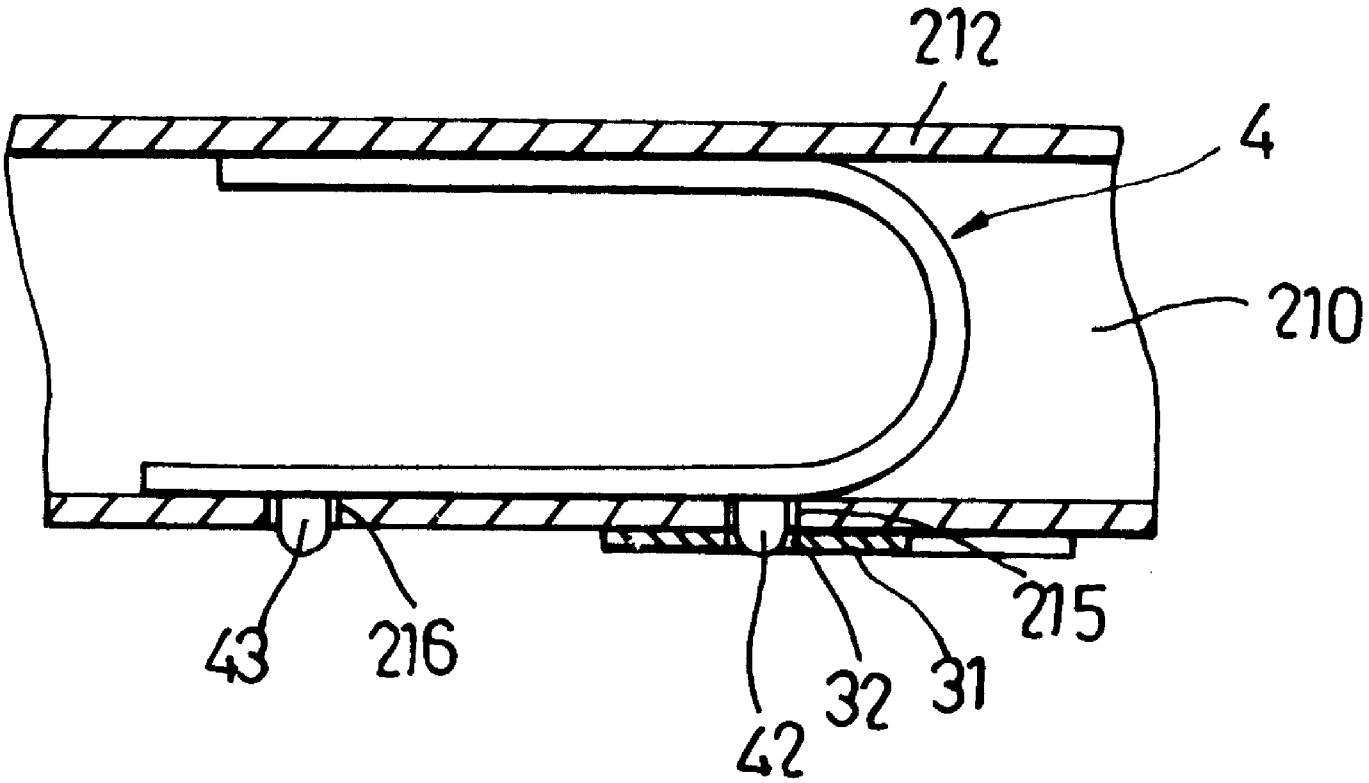
FIG. 5 is a sectional view of a portion of one side tube of the folding chair.

Referring to again to FIG. 4, there is a pair of locking plates 3 (only one is shown in FIGS. 4 and 5) each of which is mounted to the respective backrest frame member 231 by means of the respective fourth pivot shaft 251 and the respective second pivot shaft 232. Each locking plate 3 is therefore turnable synchronously with the respective, backrest frame 231 during the folding or unfolding operation of the chair 2. The lower end of each locking plate 3 can extend to the respective side tube 212 of the seat frame 21 when the chair 2 is unfolded and is provided with an outwardly curved engaging part 31. The engaging part 31 has an inclined face 311 and an engaging slot 32.

Each side tube 212 of the seat frame 21 further has, in its tube wall, a first hole 215 and a second hole 216 which are communicated with the respective passage 210, a substantially U-shaped spring plate 4 mounted inside the passage 210 confined by the tube wall, and a cap member 217 for closing the passage 210. The spring plate 4 has two opposing resilient arms one of which is provided with a protrusion 42 and a press button 43 to protrude out of the first and second holes 215 and 216, respectively, as best shown in FIG. 5. The protrusion 42 and the press button 43 are resiliently retractable inward by virtue of the resiliency of the spring plate 4. The cap member 217 is provided with a stem 218.

When the chair 2 is unfolded by moving the seat frame 21 and the backrest frame 23 away from one another, the front and rear leg frames 24 and 22 are simultaneously unfolded and separated from one another. In this situation, the locking plates 3 move forward along with the backrest frame members 231 so that the lower end of each locking plate 3 moves toward the respective first hole 215 and the protrusion 42. When reaching the protrusion 42, the inclining face 311 of the lower end of each locking plate 3 depresses the respective protrusion 42 so that the lower end thereof moves past the protrusion 42. When the engaging slot 32 of each locking plate 3 reaches the respective protrusion 42, the protrusion 42 protrudes again from the respective first hole 215 by the biasing force of the spring plate 4 and engages the engaging slot 32. As the locking plates 3 engage the protrusion 42, respectively, the locking plates 3 rigidly connect with the side tubes 212 of the seat frame 21 and lock the same against movement relative to the backrest frame 23, thereby preventing the chair 2 from being folded undesirably.

In folding the chair 2, the user may hold and move downward, with his two hands, the rear ends of the side tubes 212 while pressing the press buttons 43 to move the protrusions 42 inward and disengage the same from the engaging slots 32 of the locking plates 3. As a result, the seat frame 21 is turned downward about the first pivot shafts 213, thereby folding the chair 2 in a conventional manner.

Although the embodiment as described has its spring plates 4 provided with press buttons 43 in addition to protrusions 42, the provision of the press buttons 43 is optional. In an alternative embodiment of the chair according to the present invention, the press buttons 43 and the second holes 216 are eliminated from the spring plates 4 and the side tubes 212. Since the protrusions 42 are resiliently retractable inward from the first holes 215 of the side tubes 212 by the pressure of the locking plates 3 and are extendable outward to engage the locking plates 3, the chair can be locked or released automatically in or from its unfolded position.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What I claim is:

1. A foldable chair, comprising:

a seat frame having a front side, and two opposite side tubes extending rearward from two ends of said front side, a substantially U-shaped rear leg frame having two substantially parallel rear leg members pivoted to rear ends of said side tubes of said seat frame, respectively, first pivot shafts which connect said rear leg members to said side tubes, a substantially U-shaped backrest frame having two substantially parallel backrest frame members pivotally connected to said rear leg members, respectively, second pivot shafts which connect said rear leg members to said backrest frame members, each of said second pivot shafts being parallel to an adjacent one of said first pivot shafts, a substantially U-shaped front leg frame having two substantially parallel front leg members respectively pivoted to said side tubes of said seat frame adjacent to said front side, third pivot shafts which connect said front leg members to said side tubes, respectively, a pair of armrest members having front ends respectively pivoted to said front leg members above said side tubes and rear ends pivoted respectively to said backrest frame members above said second pivot shafts, a pair of connecting rods having front ends pivotally connected to said seat frame and said front leg frame via said third pivot shafts and rear ends pivotally connected to said backrest frame members, respectively, fourth pivot shafts which connect said connecting rods to said backrest frame members, respectively, a locking plate having an upper portion fixedly connected to one of said backrest frame members, said locking plate longitudinally extending along said one backrest frame member adjacent to a bottom end of said one backrest frame member and having a lower portion which is provided with an engaging slot, and a resilient protrusion provided in one of said side tubes adjacent to said one backrest frame member so as to releaseably engage said engaging slot when said backrest frame and said seat frame are unfolded, wherein said one side tube being substantially horizontal and extending below said bottom end of said one backrest frame member when said seat frame is unfolded, said lower portion of said locking plate extending beyond said bottom end and over said one side tube when said seat frame is unfolded, and engaging said resilient protrusion with said engaging slot, thereby rigidly connecting with said one side tube and locking said seat frame against movement relative to said backrest frame, said locking plate is connected to said one backrest frame member by means of one of said second pivot shafts and one of said fourth pivot shafts, and said one side tube is opened at the rear end thereof and has a substantially U-shaped spring plate which is inserted inside said one side tube, said spring plate having two opposing resilient arms, said resilient protrusion being formed on one of said resilient arms, said one side tube further having a tube wall and a first hole formed in said tube wall to permit said resilient protrusion to resiliently protrude outward through said first hole.

2. A foldable chair, comprising:

a seat frame having a front side, and two opposite side tubes extending rearward from two ends of said front side, a substantially U-shaped rear leg frame having two substantially parallel rear leg members pivoted to rear ends of said side tubes of said seat frame, respectively, first pivot shafts which connect said rear leg members to said side tubes, a substantially U-shaped backrest frame having two substantially parallel backrest frame members pivotally connected to said rear leg members, respectively, second pivot shafts which connect said rear leg members to said backrest frame members, each of said second pivot shafts being parallel to an adjacent one of said first pivot shafts, a substantially U-shaped front leg frame having two substantially parallel front leg members respectively pivoted to said side tubes of said seat frame adjacent to said front side, third pivot shafts which connect said front leg members to said side tubes, respectively, a pair of armrest members having front ends respectively pivoted to said front leg members above said side tubes and rear ends pivoted respectively to said backrest frame members above said second pivot shafts, a pair of connecting rods having front ends pivotally connected to said seat frame and said front leg frame via said third pivot shafts and rear ends pivotally connected to said backrest frame members, respectively, fourth pivot shafts which connect said connecting rods to said backrest frame members, respectively, a locking plate having an upper portion fixedly connected to one of said backrest frame members, said locking plate longitudinally extending along said one backrest frame member adjacent to a bottom end of said one backrest frame member and having a lower portion which is provided with an engaging slot, and a resilient protrusion provided in one of said side tubes adjacent to said one backrest frame member so as to releaseably engage said engaging slot when said backrest frame and said seat frame are unfolded, wherein said one side tube being substantially horizontal and extending below said bottom end of said one backrest frame member when said seat frame is unfolded, said lower portion of said locking plate extending beyond said bottom end and over said one side tube when said seat frame is unfolded, and engaging said resilient protrusion with said engaging slot, thereby rigidly connecting with said one side tube and locking said seat frame against movement relative to said backrest frame, said locking plate is connected to said one backrest frame member by means of one of said second pivot shafts and one of said fourth pivot shafts, said one of side tube is opened at the rear end thereof and has a substantially U-shaped spring plate which is inserted inside said one side tube, said spring plate having two opposing resilient arms, said resilient protrusion being formed on one of said resilient arms, said one side tube further having a tube wall and a first hole formed in said tube wall to permit said resilient protrusion to resiliently protrude outward through said first hole, and said spring plate further has a press button formed on said one resilient arm spacedly from said resilient protrusion, said one side tube further having a second hole formed in said tube wall to permit said press button to resiliently protrude outward through said second hole.

* * * * *